US011828053B2

(12) United States Patent
Dalton

(10) Patent No.: US 11,828,053 B2
(45) Date of Patent: Nov. 28, 2023

(54) URINE CONTAINMENT AND DEODORIZING DEVICE

(71) Applicant: Scott Dalton, East Setauket, NY (US)

(72) Inventor: Scott Dalton, East Setauket, NY (US)

( * ) Notice: Subject to any disclaimer, the term of this patent is extended or adjusted under 35 U.S.C. 154(b) by 8 days.

(21) Appl. No.: 17/828,791

(22) Filed: May 31, 2022

(65) Prior Publication Data

US 2022/0412066 A1 Dec. 29, 2022

Related U.S. Application Data

(60) Provisional application No. 63/219,943, filed on Jul. 9, 2021, provisional application No. 63/215,066, filed on Jun. 25, 2021.

(51) Int. Cl.
*E03D 9/00* (2006.01)
*E03D 13/00* (2006.01)

(52) U.S. Cl.
CPC ..... *E03D 9/005* (2013.01); *E03D 13/005* (2013.01)

(58) Field of Classification Search
CPC . A47K 13/06; E03C 1/264; E03D 13/00–007; E03D 9/005
USPC ..... 4/222.1, 300.3, 301, 309–311
See application file for complete search history.

(56) References Cited

U.S. PATENT DOCUMENTS 2,035,567 A * 3/1936 Piper ..... E03D 9/00 4/251.1
4,671,976 A 6/1987 Vidal
4,866,793 A 9/1989 Luedtke
D329,893 S 9/1992 Luedtke
5,313,672 A 5/1994 Luedtke
5,398,347 A 3/1995 Luedtke
D393,896 S 4/1998 Wagner
5,774,905 A 7/1998 Wager
5,809,590 A 9/1998 Williams
D427,295 S 6/2000 Wagner
6,550,075 B1 4/2003 Brannon
D520,610 S 5/2006 Wrate
7,398,565 B1 * 7/2008 Chou ..... E03D 13/00 4/300.3
D639,410 S 6/2011 Ramirez
8,043,498 B2 10/2011 Rueda
8,056,153 B2 11/2011 Ruedas
(Continued)

FOREIGN PATENT DOCUMENTS

JP 2002235360 * 8/2002
JP 3143949 * 8/2008
(Continued)

*Primary Examiner* — David P Angwin
*Assistant Examiner* — Nicholas A Ros
(74) *Attorney, Agent, or Firm* — Jennifer Meredith, Esq.

(57) ABSTRACT

A urine containment and deodorizing device having a funnel portion having a top side, left side, right side, bottom side, left side raised funnel portion, right side raised funnel portion, funnel portion upper side and funnel portion underneath side wherein the top side is wider than the bottom side; a bottom portion having a shaped portion, a narrower tapered portion, a bottom portion upper side, a bottom portion underneath side and at least one opening between the bottom portion upper side and the bottom portion underneath side; and a connecting portion between the narrower tapered portion of the bottom portion and the bottom side of the funnel portion.

14 Claims, 13 Drawing Sheets

(56) References Cited

U.S. PATENT DOCUMENTS

| | | | | |
|---|---|---|---|---|
| D678,482 | S | 3/2013 | Williams | |
| 8,856,976 | B1 | 10/2014 | Niedzilski | |
| 8,856,977 | B2 | 10/2014 | Ramirez | |
| D787,031 | S | 5/2017 | Morgans-Williams | |
| 10,036,154 | B2 | 7/2018 | Crevier | |
| 10,294,649 | B2 | 5/2019 | Crevier | |
| 10,988,918 | B2 | 4/2021 | Crevier | |
| 2004/0093662 | A1 | 5/2004 | Zhu | |
| 2007/0044221 | A1 | 3/2007 | Wise, Sr. | |
| 2013/0000027 | A1 | 1/2013 | San Luis | |
| 2015/0047114 | A1 | 2/2015 | Ramirez | |
| 2015/0143624 | A1 | 5/2015 | Irving | |
| 2018/0119403 | A1 | 5/2018 | Crevier | |
| 2018/0163386 | A1* | 6/2018 | Storey | E03D 13/005 |
| 2022/0039619 | A1* | 2/2022 | Barr | A47K 13/06 |
| 2022/0162845 | A1* | 5/2022 | Nathamuni | E03D 13/005 |

FOREIGN PATENT DOCUMENTS

| | | | |
|---|---|---|---|
| KR | 20120004301 | * | 6/2012 |
| KR | 200468908 | * | 9/2013 |
| WO | WO 2018/199638 | | 11/2018 |

* cited by examiner

URINE CONTAINMENT AND DEODORIZING DEVICE

This application claims priority to provisional patent application 63/215,066 filed Jun. 25, 2021 and provisional patent application 63/219,943 filed Jul. 9, 2021, the entire contents of both applications are incorporated herein by reference.

TECHNICAL FIELD

The present disclosure generally relates to devices for bathroom urinals. More particularly, and not by way of limitation, particular embodiments of the present disclosure are directed to a device that attaches to a urinal and directs urine into the drain and away from the surrounding floors.

BACKGROUND

Most men's public restrooms have urine on the floor surrounding the urinals. This causes floor corrosion and foul odors. The urine is stepped in and then tracked throughout the restroom and beyond. The problem is caused not just by the splash of urine, but the distance a user must stand from the urinal, which is not directly over the urinal. The distance and design of urinals allows for drips and dribbles of urine to hit the floors and shoes or feet.

The present invention provides a device that is intended to prevent urine from reaching floors, shoes or feet and to provide aeration and deodorization.

BRIEF DESCRIPTION OF THE INVENTION

According to one aspect of the present invention, a urine containment and deodorizing device is provided having a funnel portion having a top side, left side, right side, bottom side, left side raised funnel portion, right side raised funnel portion, funnel portion upper side and funnel portion underneath side wherein the top side is wider than the bottom side; a bottom portion having a shaped portion, a narrower tapered portion, a bottom portion upper side, a bottom portion underneath side and at least one opening between the bottom portion upper side and the bottom portion underneath side; and a connecting portion between the narrower tapered portion of the bottom portion and the bottom side of the funnel portion.

According to another aspect of the present invention, a urine containment and deodorizing device is provided having a funnel portion having a top side, left side, right side, bottom side, left side raised funnel portion, right side raised funnel portion, funnel portion upper side and funnel portion underneath side; and at least two suction cups attached to the underneath side of the funnel portion substantially along the bottom side.

BRIEF DESCRIPTION OF THE DRAWINGS

In the following section, the present disclosure will be described with reference to exemplary embodiments illustrated in the accompanying figures. For ease of discussion, the same reference numbers in different figures indicate similar or identical items.

DETAILED DESCRIPTION

In the following detailed description, numerous specific details are set forth in order to provide a thorough understanding of the disclosure. However, it will be understood by those skilled in the art that the present disclosure may be practiced without these specific details. In other instances, well-known methods, procedures and components have not been described in detail so as not to obscure the present disclosure.

Figure 1:
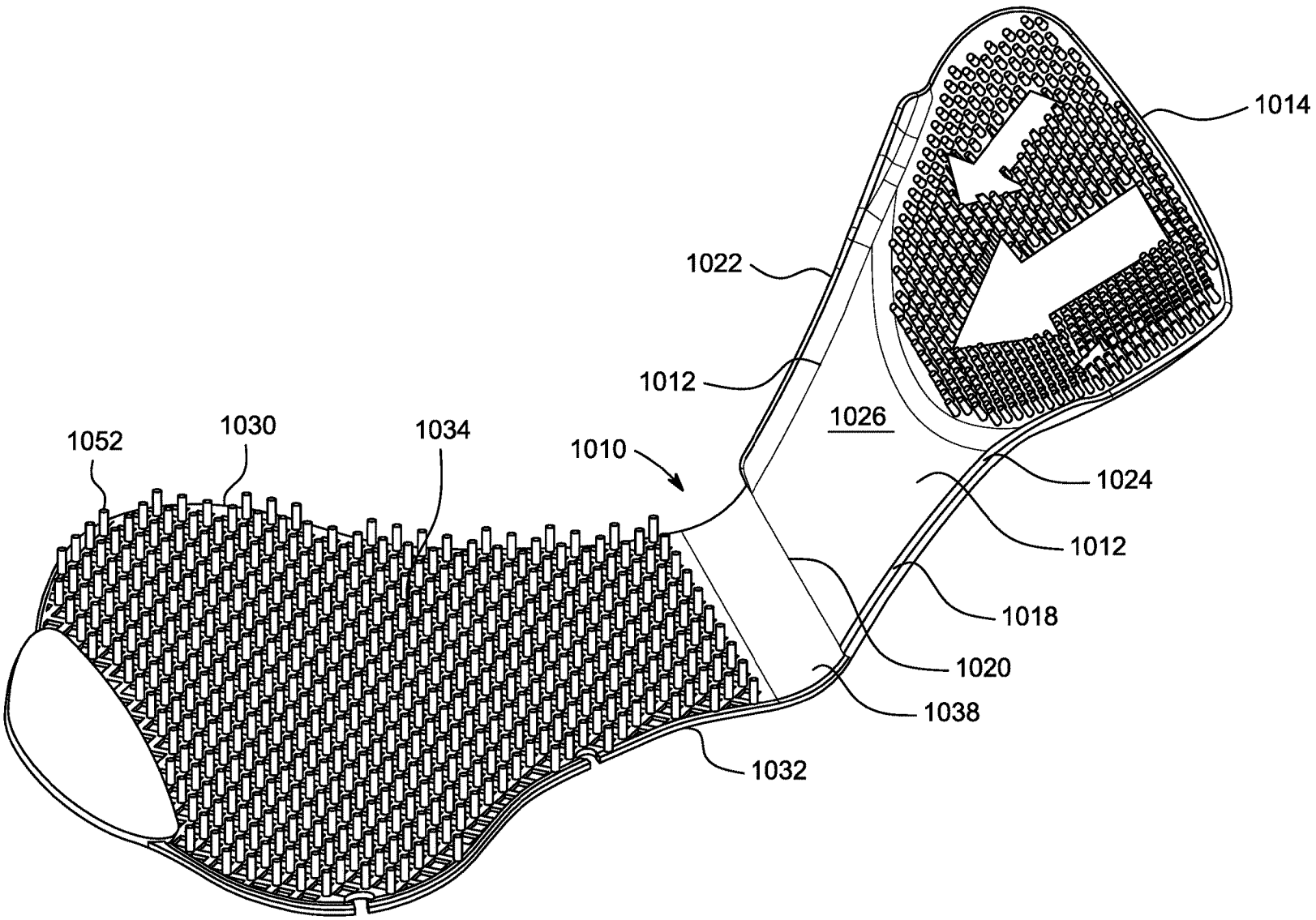
FIG. 1 depicts aspects of the present invention.
Figure 2:
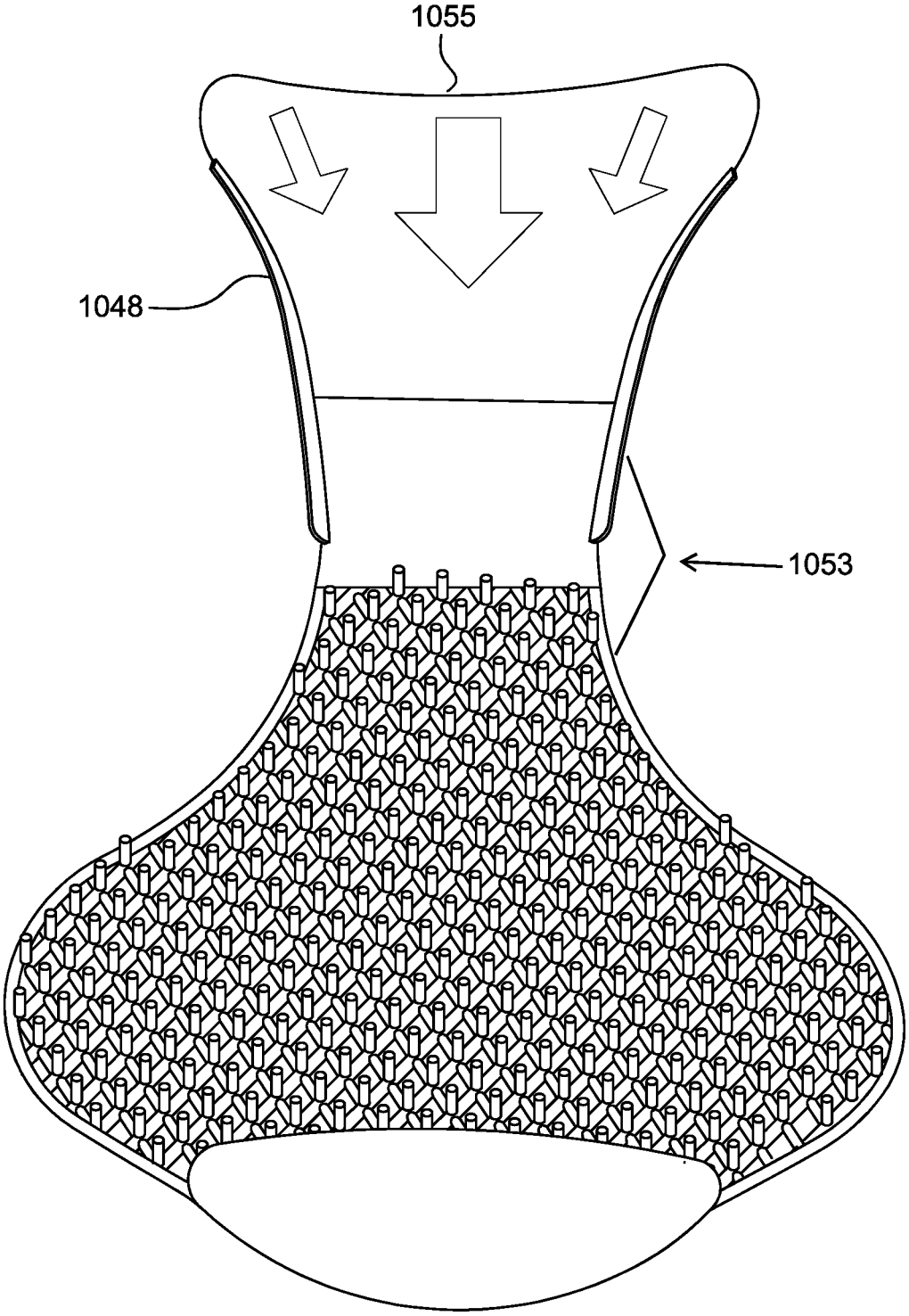
FIG. 2 depicts aspects of the present invention.
Figure 3:
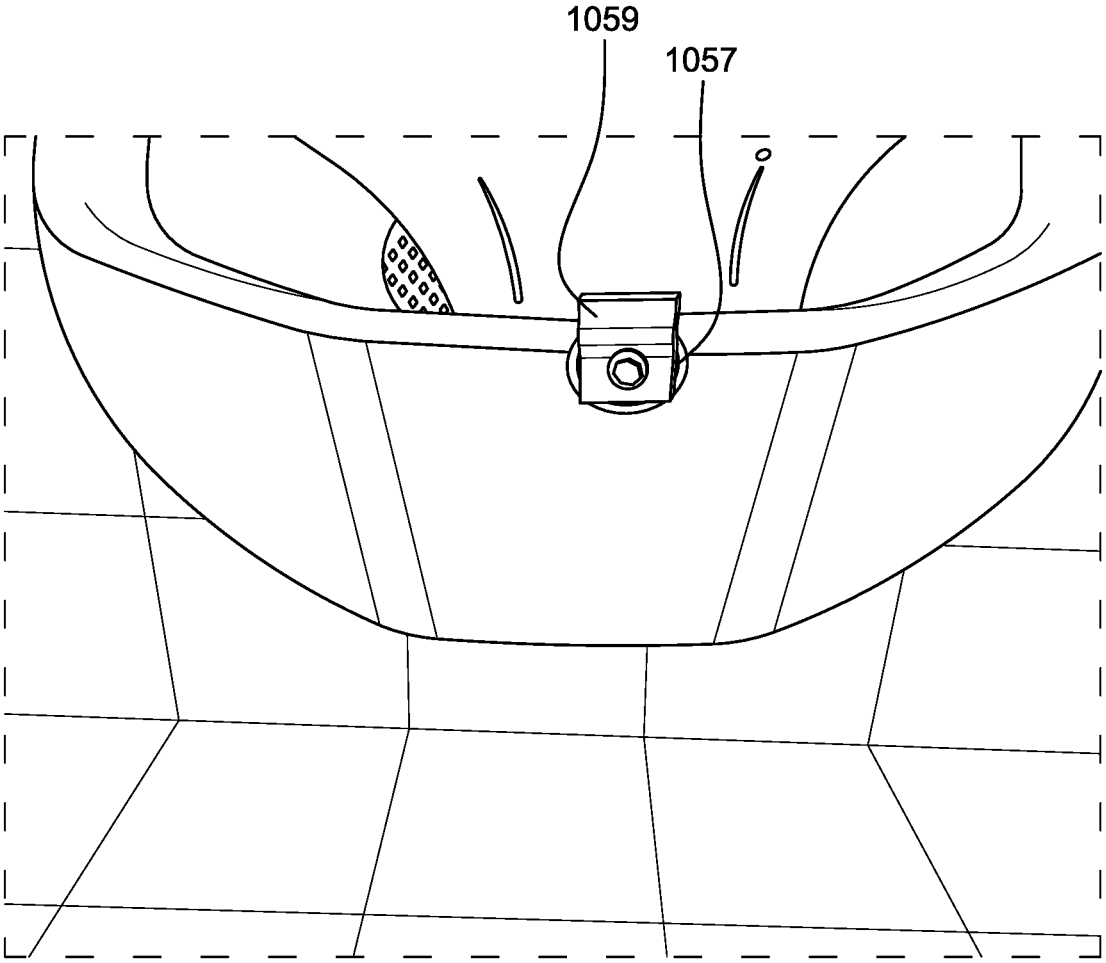
FIG. 3 depicts aspects of the present invention.
Figure 4:
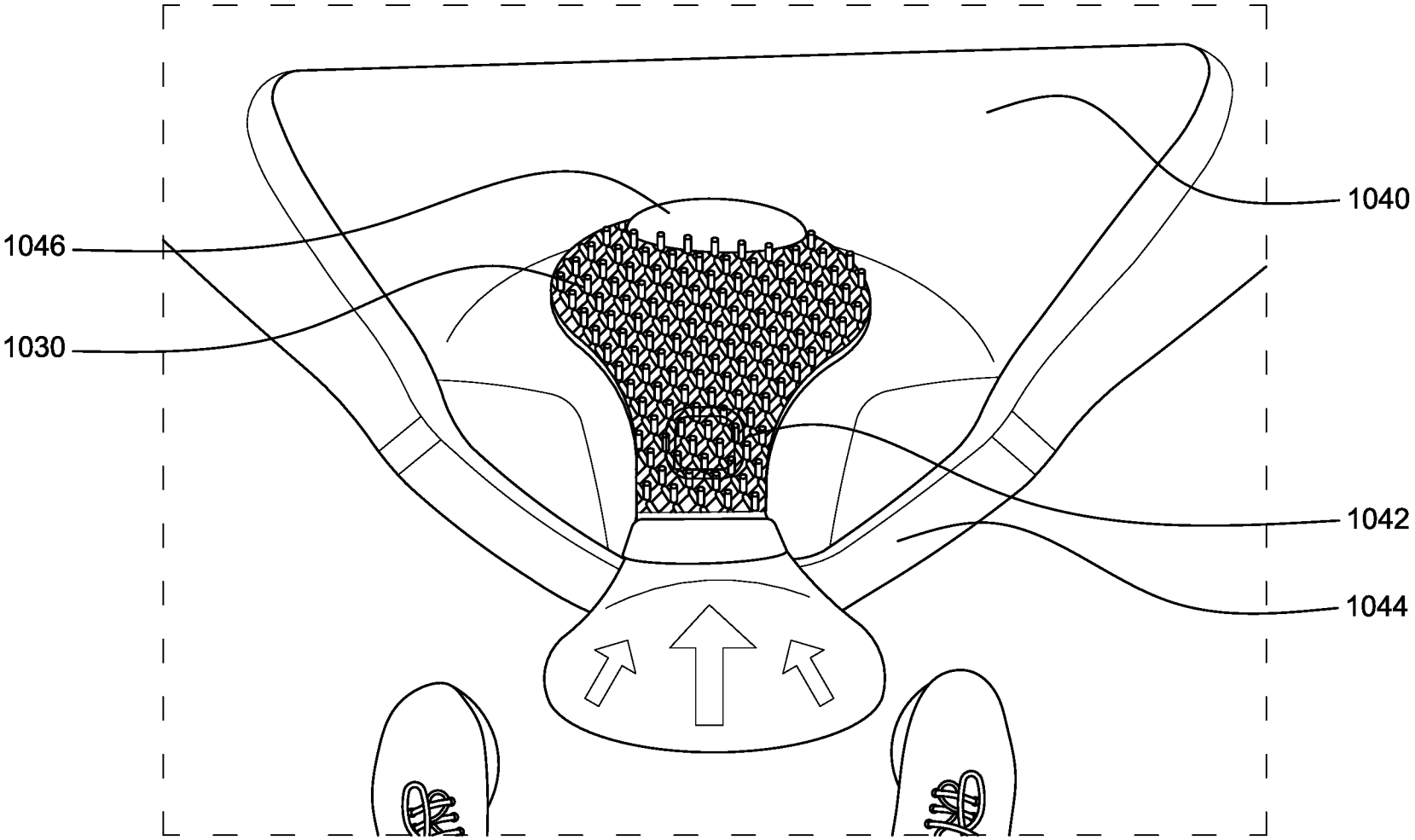
FIG. 4 depicts aspects of the present invention.
Figure 5:
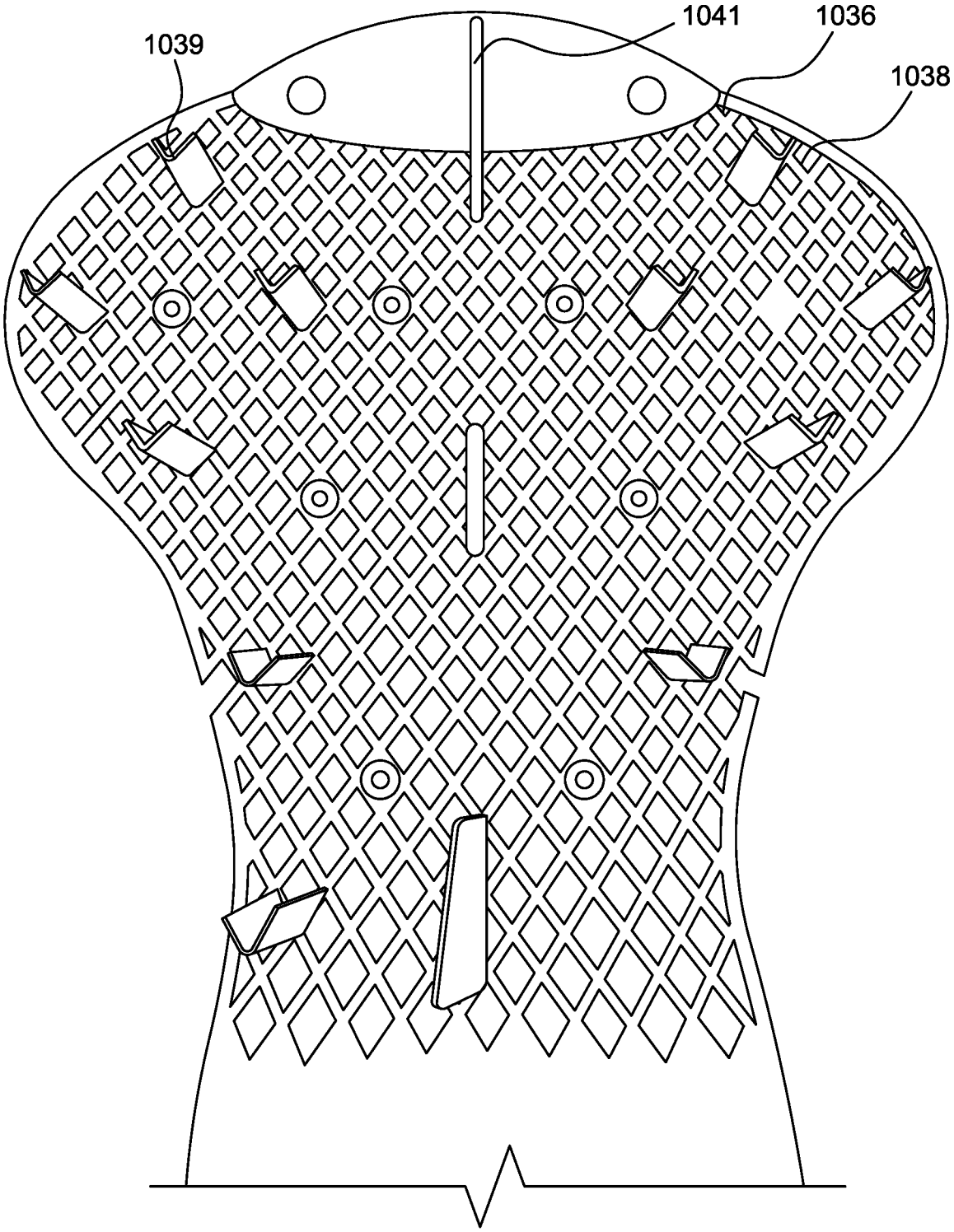
FIG. 5 depicts aspects of the present invention.

The present invention provides a urine containment and deodorizing device (1010), comprising: a funnel portion (1012) having a top side (1014), left side (1012), right side (1018), bottom side (1020), left side raised funnel portion (1022), right side raised funnel portion (1024), funnel portion upper side (1026) and funnel portion underneath side (FIG. 3, 1028) wherein the top side (1014) is wider than the bottom side (1020). The left side raised funnel portion (1022) and the right side raised funnel portion (1024) may have a curvature and may have a lip at the top to further direct urine into the drain and away from the floor and users feet. There may be a bottom portion having a shaped portion (1030), a narrower tapered portion (1032), a bottom portion upper side (1034), a bottom portion underneath side (FIG. 5, 1036) and at least one opening (FIG. 5, 1038) between the bottom portion upper side (1034) and the bottom portion underneath side (1036); and a connecting portion (1038) between the narrower tapered portion (1032) of the bottom portion and the bottom side of the funnel portion (1020). The connecting portion (1038) may also be a section or portion where the two pieces meet without departing from the present invention. The entire device may be formed of a single piece, not separate pieces, but portions or sections being referred to for the purposes of description. As can be seen in FIG. 4, the urine containment and deodorizing device (1010) is intended to sit in a urinal (1040). The at least one opening (1038) is intended to sit above the urinal drain (1042). The tapered shape allows the device to sit in the lip portion (1044) of the urinal. There may be a solid portion (1046) at an end of the shaped portion (1030). The shaped portion may be substantially paddle shaped (as depicted in FIG. 1 having a top portion that tapers to a narrower middle portion), substantially rounded (1900), substantially rectangular (2000) and substantially square (2100). The solid portion (1046, 1902, 2002, 2102) serves a number of functions. It provides extra weight to hold the device in place. It is also less flexible than the portions with openings, thus providing additional security of the device when attached to the urinal. The funnel portion (1012) may taper (1048) from the top side to the bottom side. This can be seen in FIG. 2 and serves to direct the urine into the urinal.

The plurality of openings may form a mesh pattern (1050) along an underside of the tapered bottom portion. The term mesh pattern is intended to describe that there the plurality of openings in a consistent pattern. The plurality of openings may be round shaped (2300), diamond shaped (1050), oval shaped (2400), rectangular shaped (2500) and square shaped (2600).

Figure 11:
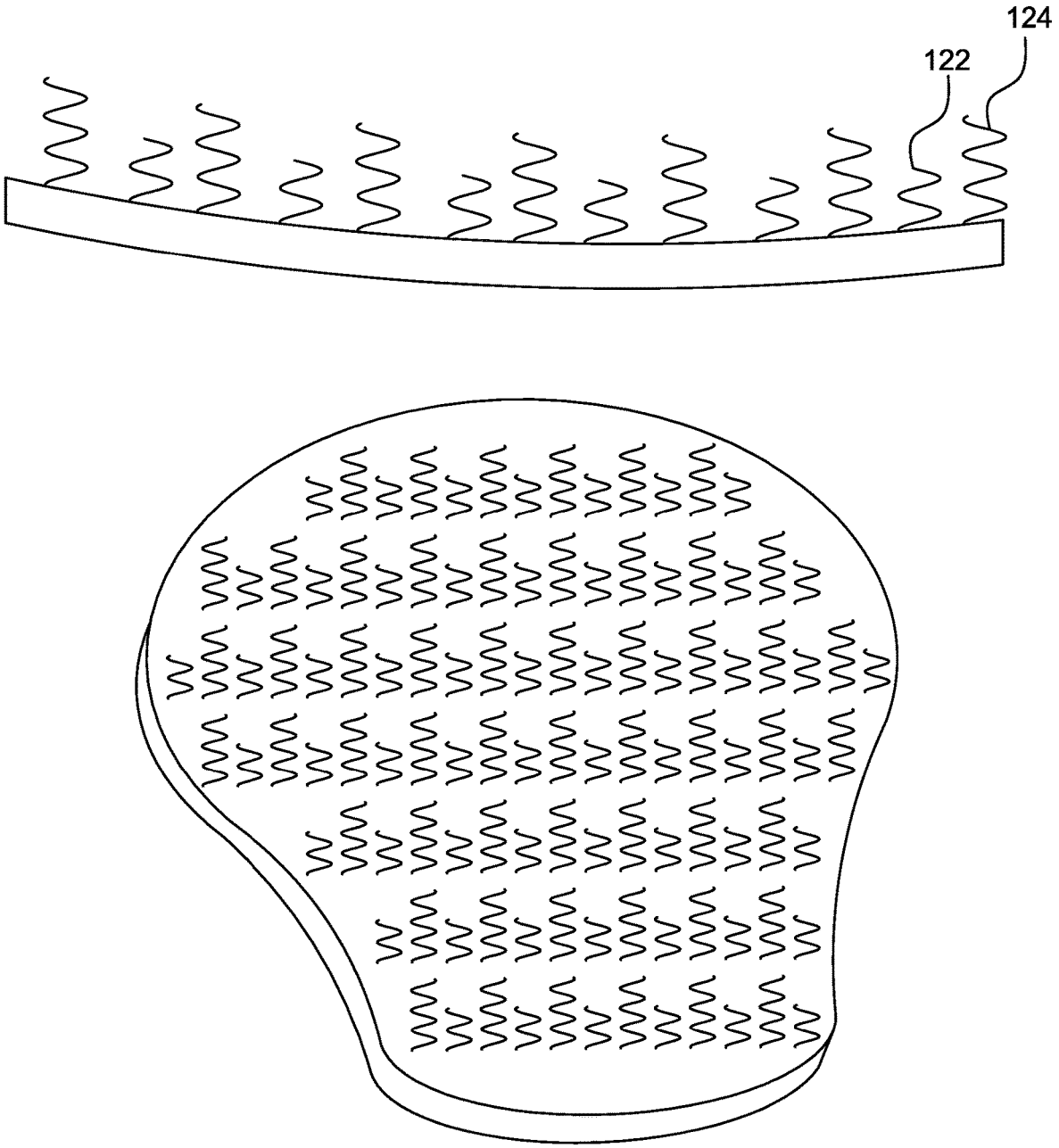
FIG. 11 depicts aspects of the present invention.
Figure 18:
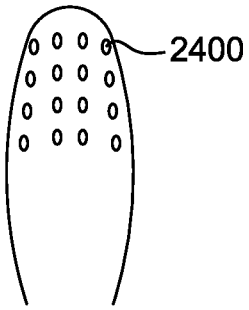
FIG. 18 depicts aspects of the present invention.
Figure 19:
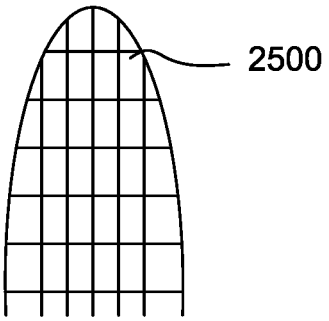
FIG. 19 depicts aspects of the present invention.
Figure 20:
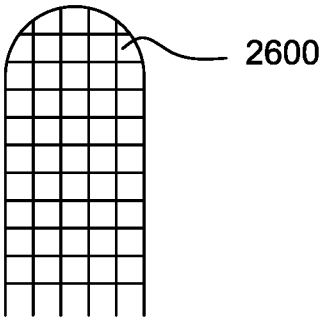
FIG. 20 depicts aspects of the present invention.
Figure 21:
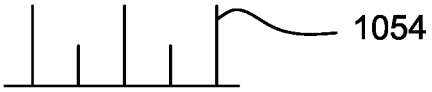
FIG. 21 depicts aspects of the present invention.
Figure 22:
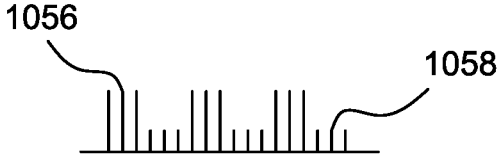
FIG. 22 depicts aspects of the present invention.

There may be least one raised projection (1052) along at least one of the funnel portion upper side (1026) and the bottom portion upper side (1034). The at least one raised projection may be plurality of raised projections of alternating heights (1054). The at least one raised projection may be a plurality of raised projections according to a pattern of alternating heights (1056, 1058). As can be seen in FIG. 22, there may be three tall raised projections (1056), then three short raised projections (1058), then three tall raised projection, then three short raised projections repeating in a pattern. There may be any pattern, this is an example of a possible pattern. FIG. 11 also depicts raised projections of a pattern (tall height 124, small height 122) and the raised projection is a spiral shape. The raised projection may take any shape without departing from the present invention, such as conical, rectangular, rounded, slender, multiple slender projections (like the bristles of a hair brush) in a single opening, spiral and bent (such as an accordion shape). The raised projections may be made of different materials, including (by way of example) silicone. The raised projections may take the form of lines (See FIG. 6), arrows (1015) and even letters (FIG. 18, 130). It is also noted that it may be the raised portions that form shapes or the absence of the raised projections that forms the shape (such as in FIG. 1 where the absence of the raised projections forms the directional indicator (arrow)). In this way, a depression is also a raised projection. Put another way, the raised portions would be the raised projections and would form the corresponding depression (such as the arrow shown in FIG. 1, similarly the lines in FIG. 6 may be depressions and the surrounding portions the raised projections). The directional indictor may be on at least one of the funnel portion upper side (1026) and the bottom portion upper side (1034). This serves the purpose of guiding installation of the device and directing the user's aim in use. It may be on the underneath/underside of the device also, but typically it is on the upper side to be viewable to the user. It should be mentioned, though, that there may be direction indictors on the underside to help with installation.

Figure 16:
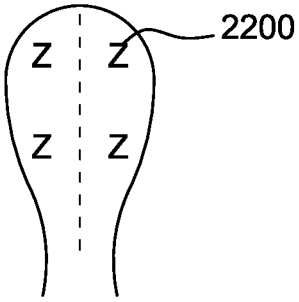
FIG. 16 depicts aspects of the present invention.
Figure 17:
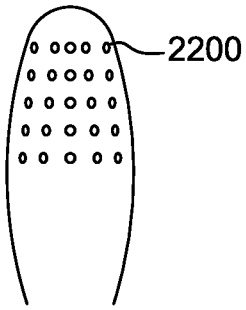
FIG. 17 depicts aspects of the present invention.

There may be a set of raised spacers (for example 1039, 1041) in communication with the bottom portion underneath side (1036). These lift the urine containment and deodorizing device up or raise the device. This performs a number of functions including better drainage and better aeration. The raised spacers also make the device more secure when sitting in the urinal. The raised spacer may be V-shaped raised spacers (1039), I-shaped raised spacers (1041) and Z-shaped raised spacers (FIG. 16, 2200). It may be desirable to have the I-shaped raised spacers along a centerline of the bottom portion underneath side and the v-shaped or z-shaped raised spacers along the left or right sides of the bottom portion underneath side. This provides additional stability along the sides and flexibility along the centerline so as to securely conform to the inside of the urinal. The funnel portion tapers from the top side to the bottom at an angle of indentation (1053) between 95 and 175 degrees, preferably between 120 and 160 degrees. The funnel portion may have a rounded depression (1055) sloping from the left side and the right side to a middle portion. This can be seen in FIG. 2 as a slight cup shape which acts to direct the urine to the center.

There may be at least one suction cup (1057) attached to at least one of the funnel portion underneath side, the bottom portion underneath side and an underneath side of the connecting portion. The suction cup may be attached by a connector (1059) which acts to hold the suction cup to any portion of the device. There may be an additional splash screen (102) and a deodorizer. They may be separate or formed as a single item (82).

Figure 6:
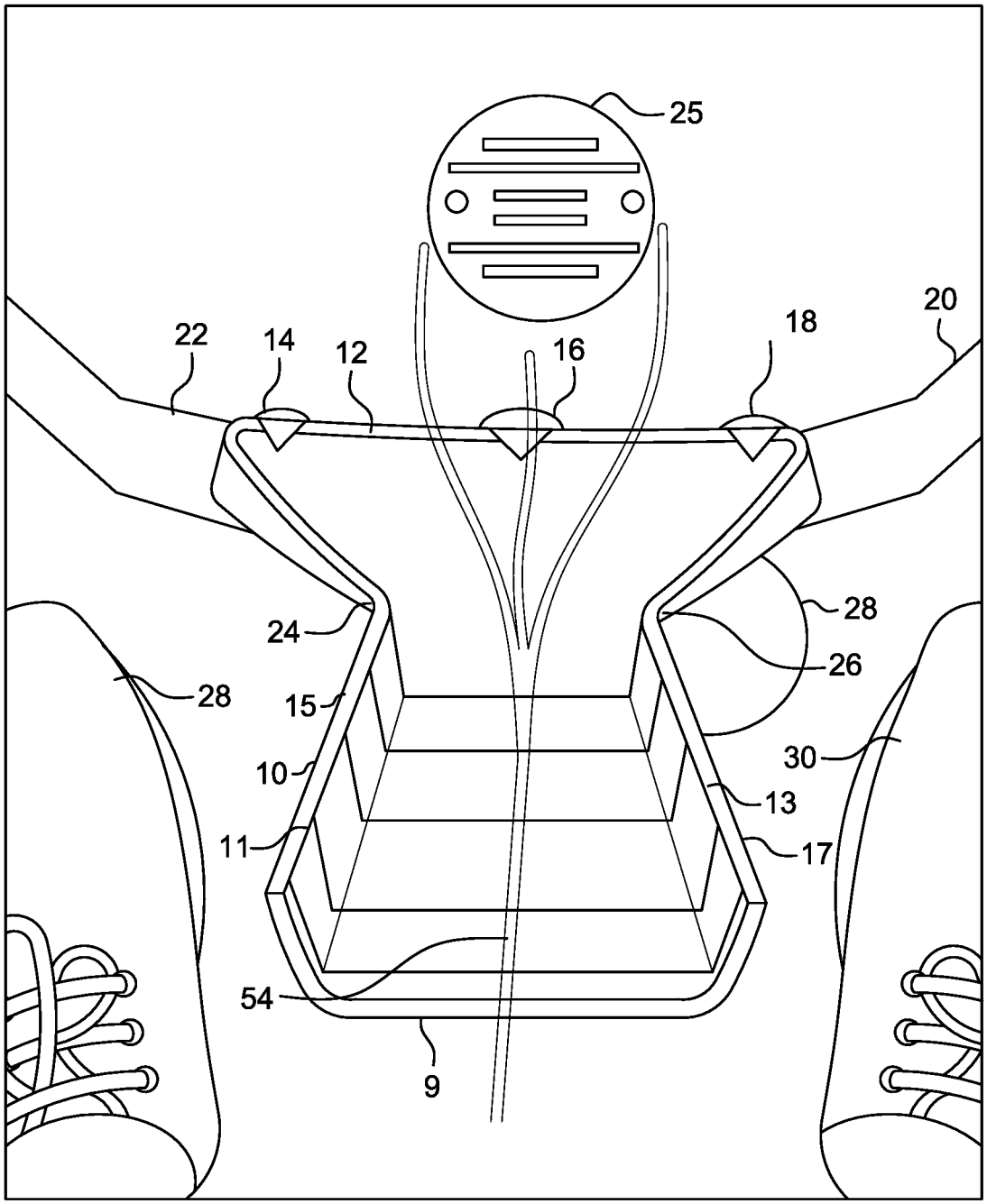
FIG. 6 depicts aspects of the present invention.

According to another embodiment, as depicted in FIG. 6, a urine containment and deodorizing device is provided that is intended to sit on the lip of the urinal. The device having a funnel portion having a top side (9), left side (11), right side (13), bottom side (12), left side raised funnel portion (15), right side raised funnel portion (17), funnel portion upper side (19) and funnel portion underneath side (as depicted in other photos this is the underside of the funnel portion not depicted/underneath); and at least two suction cups (e.g. 14, 16, 18) attached to the underneath side of the funnel portion substantially along the bottom side. There are preferably three suctions cups (14, 16, 18) and they may be attached to at least one of the funnel portion underneath side, the bottom portion underneath side and an underneath side of the connecting portion. When attached to the urinal, the suction cups may be on the inside lip (22) of the urial (20) positioned in front of the urinal drain (25). The Urine Containment and Deodorizing device (10) may have a left side indentation (24) and a right side indentation (26). The angle of this may be between 95 and 175 degrees, preferably between 120 and 160 degrees. The angle is critical, as this allows for maximum coverage, while allowing for the left foot (28), right foot (30) and shins not to be touched. It also allows the top side to protrude out far enough to catch the urine. An example of a urine stream (54) is depicted being directed into the drain (56). According to this embodiment, the bottom side is wider than the top side and there is a tapered center portion.

Figure 8:
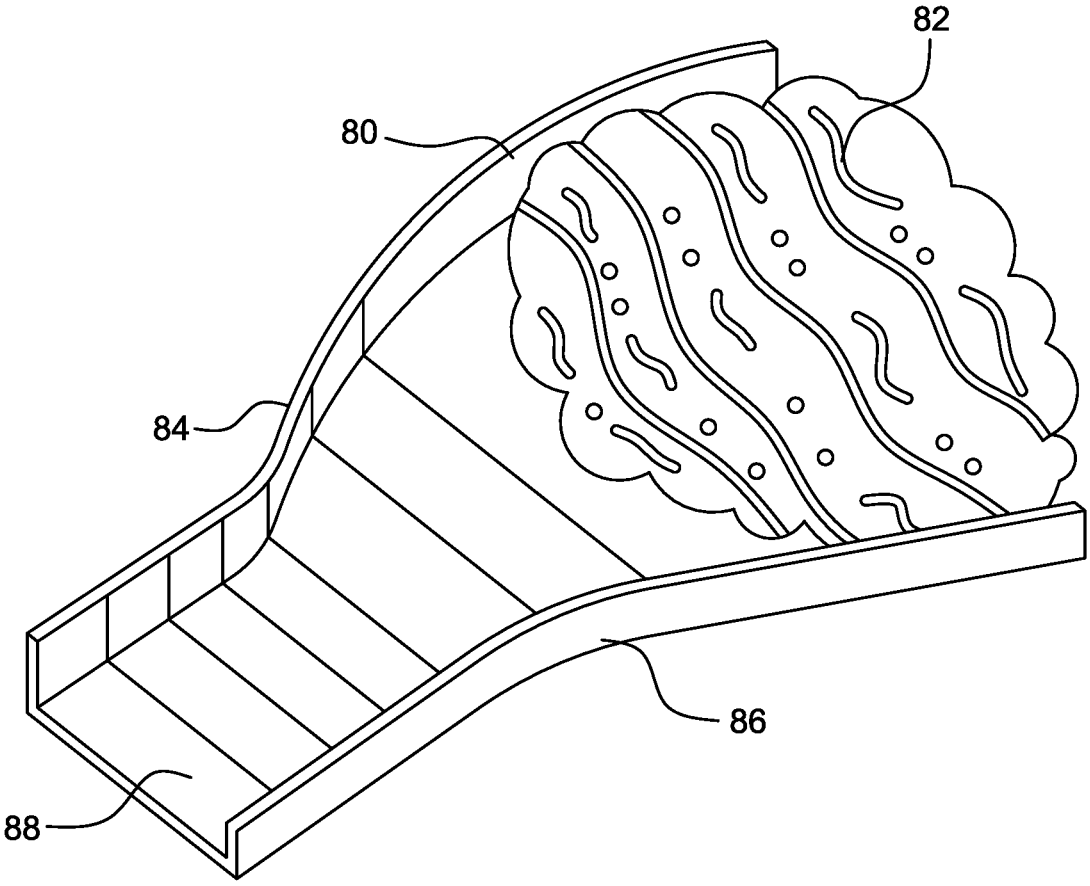
FIG. 8 depicts aspects of the present invention.

As shown in FIG. 8, the top side (82) may be wider than the bottom side (88) and there is a tapered center portion (85). The term taper refers to a gradual narrowing. This also depicts that there is the top side (82) has a splash screen incorporated therein. There is a bottom side (88) and a left side raised funnel portion (84) and right side raised funnel portion (86) between the top side (82) and the bottom side portion (88).

As described above with reference to another embodiment, there may be a plurality of raised projections of alternating heights, forming different shapes and patterns and at different locations. The funnel portion may have a tapered midsection. There may be a set of raised spacers in communication with the bottom portion underneath side. The raised spacers may be, by way of example, V-shaped raised spacers, I-shaped raised spacers and Z-shaped raised spacers.

Figure 7:
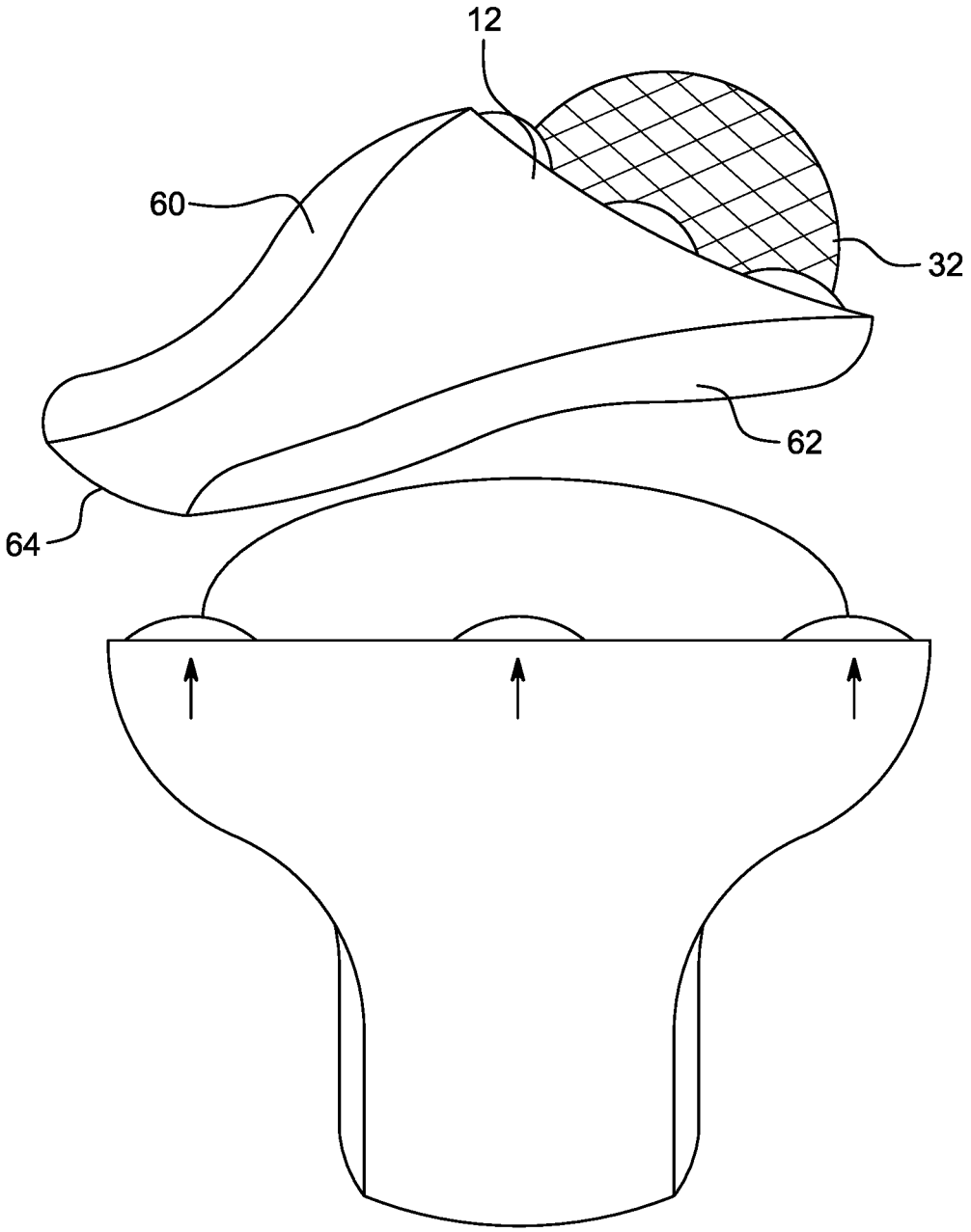
FIG. 7 depicts aspects of the present invention.

As depicted in FIG. 7, the Urine Containment and Deodorizing device may have a deodorizing pad (32) attached to the front portion (12) of the device. It may be round, as shown, rectangular or any shape that fits inside the urinal. The Deodorizing device may be a pad impregnated with a chemical. Two examples would be a surfactant and/or a Quaternary ammonium cations (also known as quats). Surfactants are compounds that lower the surface tension (or interfacial tension) between two liquids, between a gas and a liquid, or between a liquid and a solid. Surfactants may act as detergents, wetting agents, emulsifiers, foaming agents, or dispersants. Quaternary ammonium cations, also known as quats, are positively charged polyatomic ions of the structure $NR^+_4$, R being an alkyl group or an aryl group. Unlike the ammonium ion ($NH^+_4$) and the primary, secondary, or tertiary ammonium cations, the quaternary ammonium cations are permanently charged, independent of the pH of their solution. Quaternary ammonium salts or quaternary ammonium compounds (sometimes called quaternary amines) are salts of quaternary ammonium cations.

FIG. 7 depicts that there may raised side flaps on opposing sides of the device. For example, there may be a raised left side flap (60) opposite a raised right side flap (62) which are between the front portion (12) and the rear portion (64) of the device. This further directs the urine and prevents leakage.

FIG. 8 is intended to depict the device as a single one piece unit that may be utilized with or without suction cups. In this embodiment, the device is shaped to fit into the urinal bowl in a reciprocal manner such that the suction cups may not be required. It is noted that there are many shapes and sizes of urinals, so it may vary according to the urinal. It is envisioned, though, that there are popular sizes and shapes of urinals which may allow for the specifically shaped one piece funnel and splash screen that does not require suction cups (but they may be added for additional attachment). The splash screen being incorporated as one piece into the device provides added value as providing less mess and manufacturing cost savings. The deodorizing device, as above, may be incorporated in communication with the splash screen.

As shown in FIG. 8, there is a front portion (82) with the splash screen incorporated therein. There is a rear portion (88) and a raised left side flap (84) and raised right side flap (86) between the front portion (82) and the rear portion (88).

Figure 9:
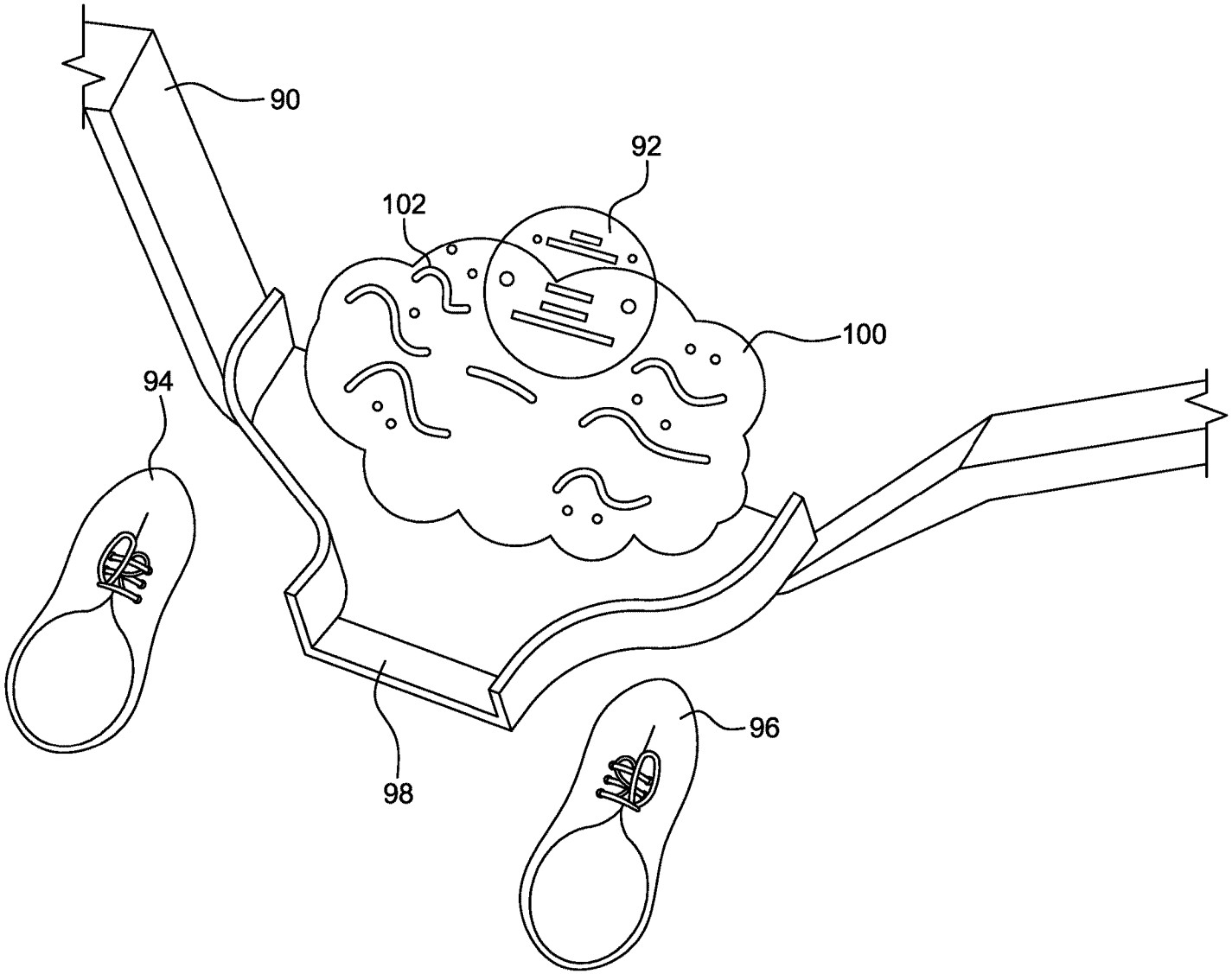
FIG. 9 depicts aspects of the present invention.

FIG. 9 depicts the device in use. As can be seen, the device (100) fits in the urinal bowl. Note that the device tapers from the wider front portion (102) to the rear portion (98). This serves two purposes, the shape can act to secure the device to the urinal. Also, as can be seen the users left foot (94) and right foot (96) may comfortably fit on either side of the narrower rear portion (98). The rear portion (98) being narrower that the front portion (102) also acts to direct the urine into the drain (92) and protect the floor and the users pant legs.

There may be a water receiving channel (formed by projections and/or depressions) along a center portion. It is noted that nature of the device in use being installed such that funnel portion is higher than the bottom portion allows gravity to drain the urine, but additional projections and depressions can break up the stream and/or further direct the urine into the drain.

Figure 10:
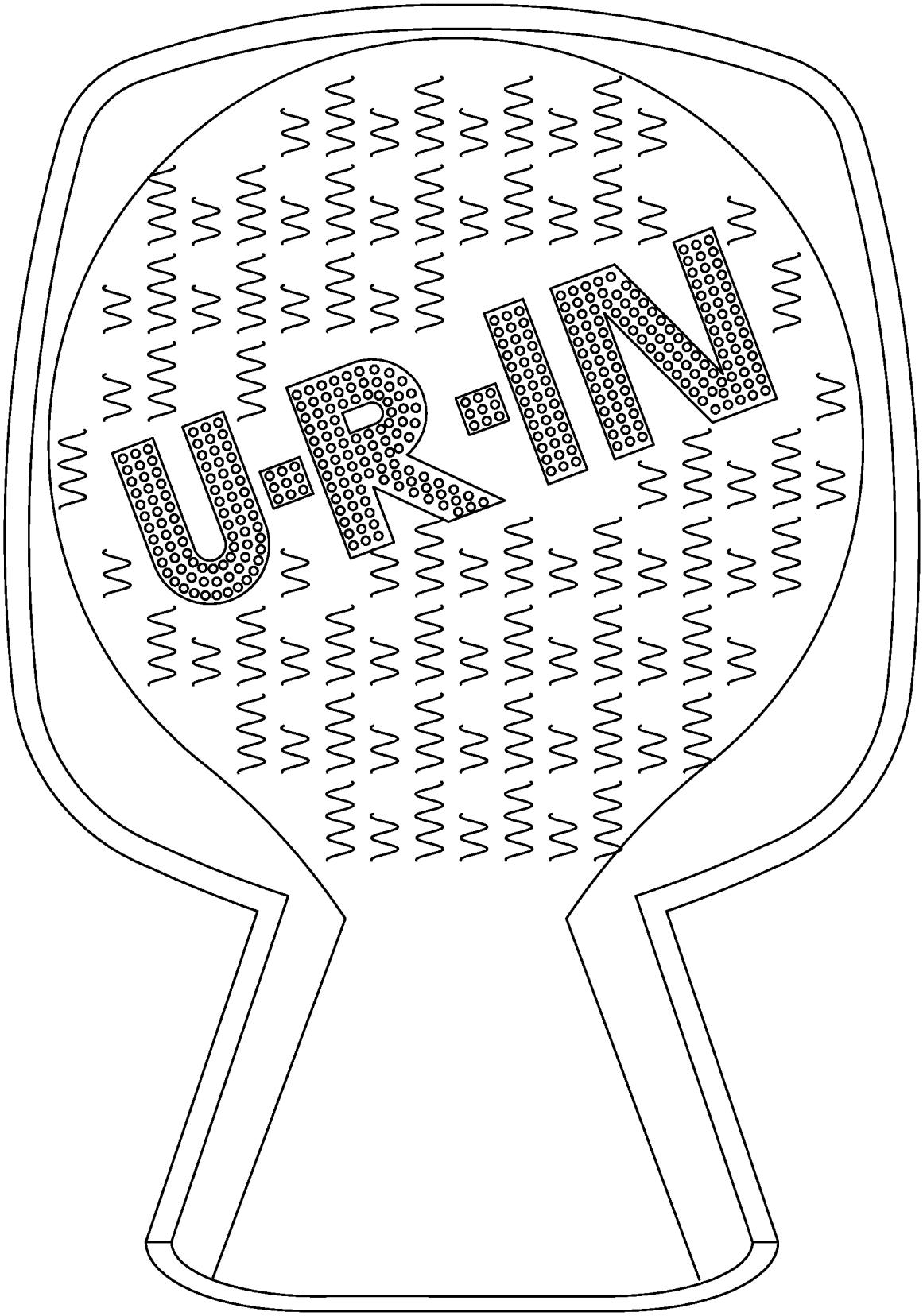
FIG. 10 depicts aspects of the present invention.
Figure 12:
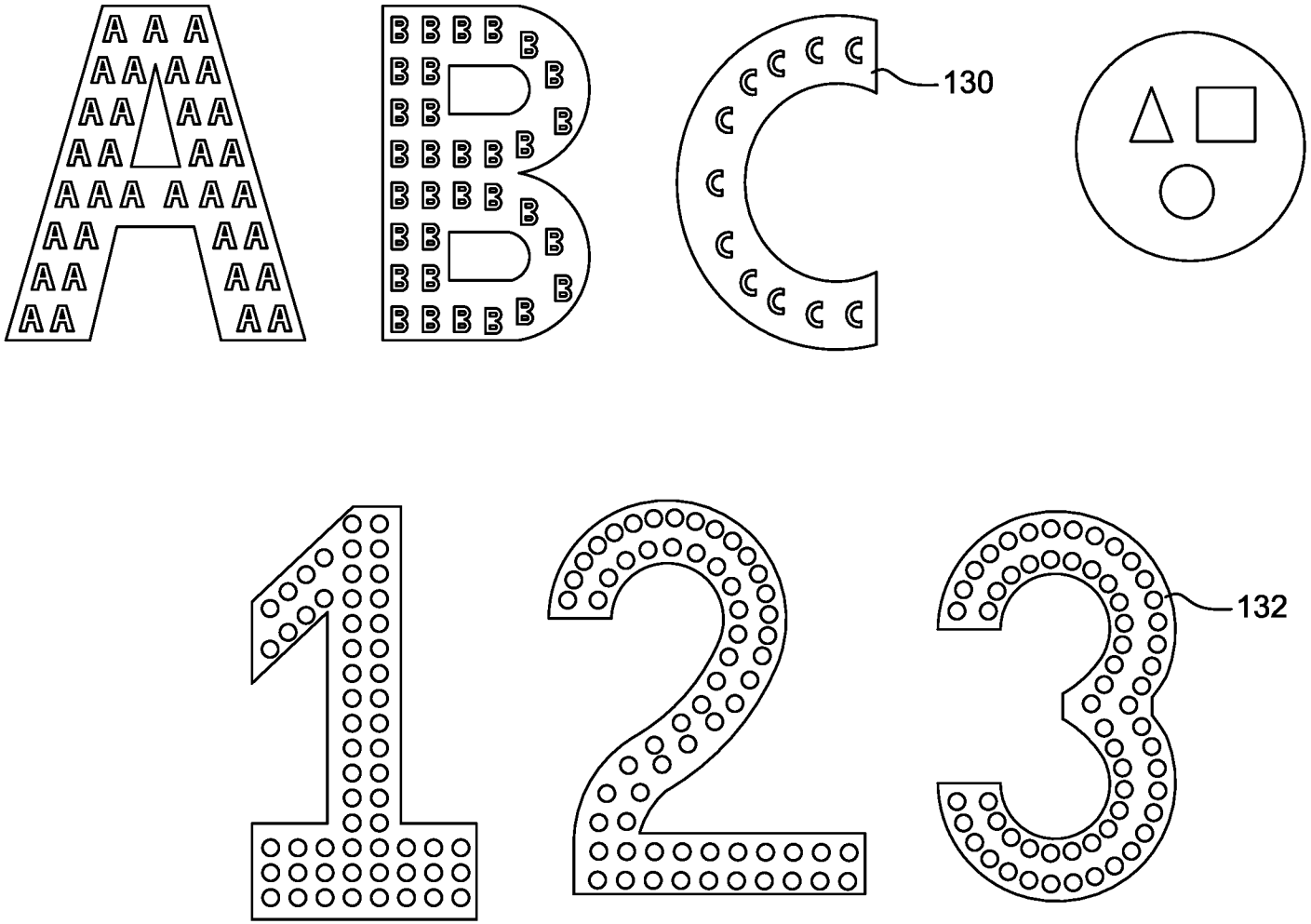
FIG. 12 depicts aspects of the present invention.
Figure 13:
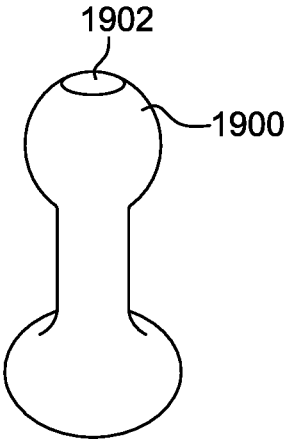
FIG. 13 depicts aspects of the present invention.
Figure 14:
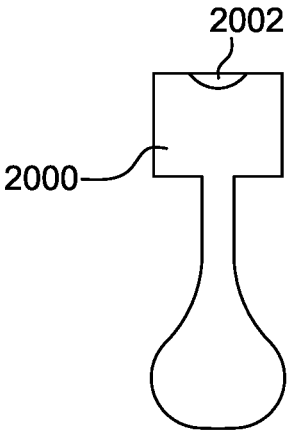
FIG. 14 depicts aspects of the present invention.
Figure 15:
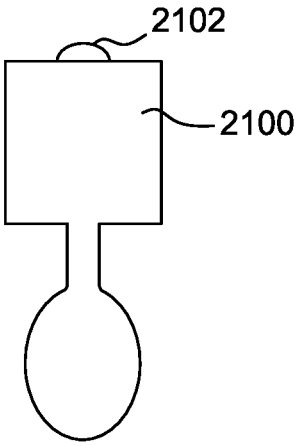
FIG. 15 depicts aspects of the present invention.

FIGS. 10 and 12 depicts that there may be raised perforated letters (122, 124) that act as the splash screen. FIG. 11 depicts that there may be silicone springs. The silicone may be of varying heights and shapes. According to one embodiment, they may be in a pattern of high height silicone spring (124) and low height silicone spring (122). The springs may be on top of, or a part of, the splash screen. FIG. 12 depicts that the raised portions of the splash pad may be anything desired. As shown there may be letters (130) and numbers (132). It is also envisioned there may be logos, for example.

Reference throughout this specification to "one embodiment" or "an embodiment" means that a particular feature, structure, or characteristic described in connection with the embodiment is included in at least one embodiment of the present disclosure. Thus, the appearances of the phrases "in one embodiment" or "in an embodiment" or "according to one embodiment" (or other phrases having similar import) in various places throughout this specification are not necessarily all referring to the same embodiment. Furthermore, the particular features, structures, or characteristics may be combined in any suitable manner in one or more embodiments. Also, depending on the context of discussion herein, a singular term may include its plural forms and a plural term may include its singular form. Similarly, a hyphenated term may be occasionally interchangeably used with its non-hyphenated version, and a capitalized entry may be interchangeably used with its non-capitalized version. Such occasional interchangeable uses shall not be considered inconsistent with each other.

In the preceding description, for purposes of explanation and not limitation, specific details are set forth in order to provide a thorough understanding of the disclosed technology. However, it will be apparent to those skilled in the art that the disclosed technology may be practiced in other embodiments that depart from these specific details. That is, those skilled in the art will be able to devise various arrangements which, although not explicitly described or shown herein, embody the principles of the disclosed technology. In some instances, detailed descriptions of well-known devices and methods are omitted so as not to obscure the description of the disclosed technology with unnecessary detail. All statements herein reciting principles, aspects, and embodiments of the disclosed technology, as well as specific examples thereof, are intended to encompass both structural and functional equivalents thereof. Additionally, it is intended that such equivalents include both currently known equivalents as well as equivalents developed in the future, such as, for example, any elements developed that perform the same function, regardless of structure.

As will be recognized by those skilled in the art, the innovative concepts described in the present application can be modified and varied over a wide range of applications. Accordingly, the scope of patented subject matter should not be limited to any of the specific exemplary teachings discussed above, but is instead defined by the following claims.

What is claimed is:

1. A urine containment and deodorizing device, comprising:

a funnel portion having a top side, left side, right side, bottom side, left side raised funnel portion, right side raised funnel portion, funnel portion upper side and funnel portion underneath side wherein the top side is wider than the bottom side;

a bottom portion having a shaped portion, a narrower tapered portion, a bottom portion upper side, a bottom portion underneath side and a plurality of openings between the bottom portion upper side and the bottom portion underneath side that form a mesh pattern, wherein the plurality of openings are selected from the group consisting of round shaped, diamond shaped, oval shaped, rectangular shaped and square shaped; and a connecting portion between the narrower tapered portion of the bottom portion and the bottom side of the funnel portion.

2. A urine containment and deodorizing device as in claim 1, wherein the funnel portion tapers from the top side to the bottom side.

3. A urine containment and deodorizing device as in claim 1, wherein the shaped portion is selected from the group consisting of paddle shaped, rounded, rectangular and square.

4. A urine containment and deodorizing device as in claim 1, further comprising a directional indictor on at least one of the funnel portion upper side and the bottom portion upper side.

5. A urine containment and deodorizing device as in claim 1, wherein the funnel portion tapers from the top side to the bottom portion at an angle of indentation between 95 and 175 degrees.

6. A urine containment and deodorizing device as in claim 1, further comprising at least one suction cup attached to at least one of the funnel portion underneath side, the bottom portion underneath side and an underneath side of the connecting portion.

7. A urine containment and deodorizing device as in claim 1, further comprising at least one of a splash screen and a deodorizer.

8. A urine containment and deodorizing device as in claim 1, wherein the funnel portion has a rounded depression sloping from the left side and the right side to a middle portion.

9. A urine containment and deodorizing device as in claim 1, further comprising a solid portion at an end of the shaped portion.

10. A urine containment and deodorizing device as in claim 1, further comprising at least one raised projection along at least one of the funnel portion upper side and the bottom portion upper side.

11. A urine containment and deodorizing device as in claim 10, wherein the at least one raised projection is a plurality of raised projections of alternating heights.

12. A urine containment and deodorizing device as in claim 10, wherein the at least one raised projection is a plurality of raised projections according to a pattern of alternating heights.

13. A urine containment and deodorizing device as in claim 1, further comprising a set of raised spacers in communication with the bottom portion underneath side.

14. A urine containment and deodorizing device as in claim 13, wherein the raised spacers are selected from the group consisting of V-shaped raised spacers, I-shaped raised spacers and Z-shaped raised spacers.

* * * * *